United States Patent [19]

Krimmel

[11] 4,416,545

[45] Nov. 22, 1983

[54] MIXER

[76] Inventor: Heinz Krimmel, Ludwigsburgerstrasse 14, D-7015 Korntal-Münchingen-1, Fed. Rep. of Germany

[21] Appl. No.: 361,766

[22] Filed: Mar. 25, 1982

[30] Foreign Application Priority Data

Mar. 31, 1981 [DE] Fed. Rep. of Germany ..... 3112685

[51] Int. Cl.[3] ..... B01F 7/02; B28C 1/16

[52] U.S. Cl. ..... 366/99; 366/100; 366/185; 366/61; 192/91 A

[58] Field of Search ..... 366/69, 92, 96, 97, 366/98, 99, 185, 189, 195, 196, 61, 45, 46, 56, 93, 94; 254/299, 317; 192/91 A; 74/813 R, 813 C, 813 L, 816

[56] References Cited

U.S. PATENT DOCUMENTS

| | | | |
|---|---|---|---|
| 1,019,076 | 3/1912 | Oleman | 366/99 |
| 3,160,398 | 12/1964 | Green | 366/61 |
| 3,754,737 | 8/1973 | O'Dea | 366/61 |
| 4,161,893 | 7/1979 | Black | 74/813 C X |

*Primary Examiner*—Harvey C. Hornsby
*Assistant Examiner*—Shewen Bian

[57] ABSTRACT

A mixer having a mixing trough rotatable about a longitudinal axis with a charging and discharging opening and rotatable mixing and kneading blades within the trough is provided. A mixing shaft is connected to the blade and is driven by at least one hydraulic motor coupled directly to the mixing shaft. The motor is reversibly drivable by means of a displacement-controllable pressure pump. A driving clutch is provided between the mixing shaft and the mixing trough so that the mixing trough can be rotated and locked into different pivotal positions by an indexing fixing device.

6 Claims, 4 Drawing Figures

MIXER

FIELD OF THE INVENTION

This invention relates to a mixer comprising a mixing though having a charging and discharging opening, said mixing trough being selectively pivotable about a longitudinal axis, a mixing shaft rotatable by at least one motor, and mixing and kneading blades, connected to the mixing shaft.

BACKGROUND OF THE INVENTION

Known mixers, as shown by German Patent Specification No. 572715, have two shafts with the drive being centrally positioned in a back gear in which distribution then takes place on to the oppositely driven mixing shafts. The mixing trough can be rotated about a longitudinal axis, which is aligned with the longitudinal axis of the main drive shaft leading into the back gear. The mixing trough is held in its normal operating position by a brake. If the brake is released, the mixing container is pivoted about its longitudinal axis and out of the normal position by friction between the mixing and kneading blades and the inner wall of the mixing trough. In order to pivot the mixing trough from the discharge position into its normal operating position, an additional friction gear is provided. This known construction is very complicated and does not readily permit control of the pivoting speed. Also, operation when the mixing trough is out of its normal position is not possible.

It is also known from German Patent Specification No. 976415 to provide a batchwise operable mixer with a mixing trough, which can be pivoted for emptying purposes. The pivoting is effected by means of a piston-cylinder drive arranged eccentrically to the pivot axis and subject to the action of a pressure medium. Thus a separate drive is provided, which is considered to be disadvantageous. It is also difficult with such drives to achieve large pivoting angles.

OBJECT AND SUMMARY OF THE INVENTION

It is an object of the present invention to provide a mixer, of the aforementioned type, in which an accurately controllable pivoting of the mixing trough is possible at a low manufacturing cost.

Another object of the invention is to provide a mixer comprising a mixing trough having a charging and discharging opening which is selectively pivotable about a longitudinal axis, at least one mixing shaft rotatable by at least one motor, mixing and kneading blades connected to the mixing shaft, said mixing trough being pivotable by means of the motor and capable of being fixed in the normal operating position. The motor comprises at least one hydraulic motor directly coupled to the mixing shaft which is reversibly drivable by means of a displace-controllable pressure pump.

A further object of the present invention is to provide a driving clutch between the mixing shaft and the mixing trough and indexing means to fix the mixing trough in different predetermined pivoted positions.

Still another object is to provide a mixer where pivoting of the mixing trough is controlled solely by the drive motor and not by reaction moments occurring during the mixing operation.

In keeping with one aspect of the invention, a mixer is provided having a clutch that couples the mixing shaft and the mixing trough in a direct manner by positive or non-positive engagement. The drive motor has at least one reversible hydraulic motor and a displacement-controllable pressure pump is used. Thus, it is possible to perform a precisely controlled, slow pivoting movement of the mixing trough.

Displacement-controllable pumps, which can be axial or radial piston pumps, even with a zero displacement setting, deliver a very low creep flow, which can be used to impart a circumferential speed of one r.p.m. to the mixer trough coupled to the mixing shaft. As a result of being able to fix the mixing trough in an indexable manner, it can be secured and operated in different operating positions when it is pivoted out of its normal upright position. This is of particular value if a large amount of aggregate is to be supplied to the mixing trough from above by means of metering devices, the outlets of which cannot all be placed over the charging and discharging opening in the normal upright position. In such a case, the mixing trough can be pivoted for receiving the aggregates. Furthermore, the mixing trough can be operated in a position in which finished mixed material can be discharged very slowly, corresponding to the particular mixing state.

Preferably, the hydraulic motor and the pressure pump are interconnected by means of fluid lines. A back pressure valve controllable by a pilot valve is provided in at least one fluid line.

As a result of these measures, it is possible to lock hydraulically the mixing trough in the sloping position, following a movement. Preferably, at least one hydraulic motor is carried by the mixing shaft and, with respect to a fixed base plate, is only supported in a torque-resistant manner.

BRIEF DESCRIPTION OF THE DRAWINGS

The invention will now be further described, by way of example, with reference to the drawings, in which.

DETAILED DESCRIPTION OF PREFERRED EMBODIMENTS

Figure 1:
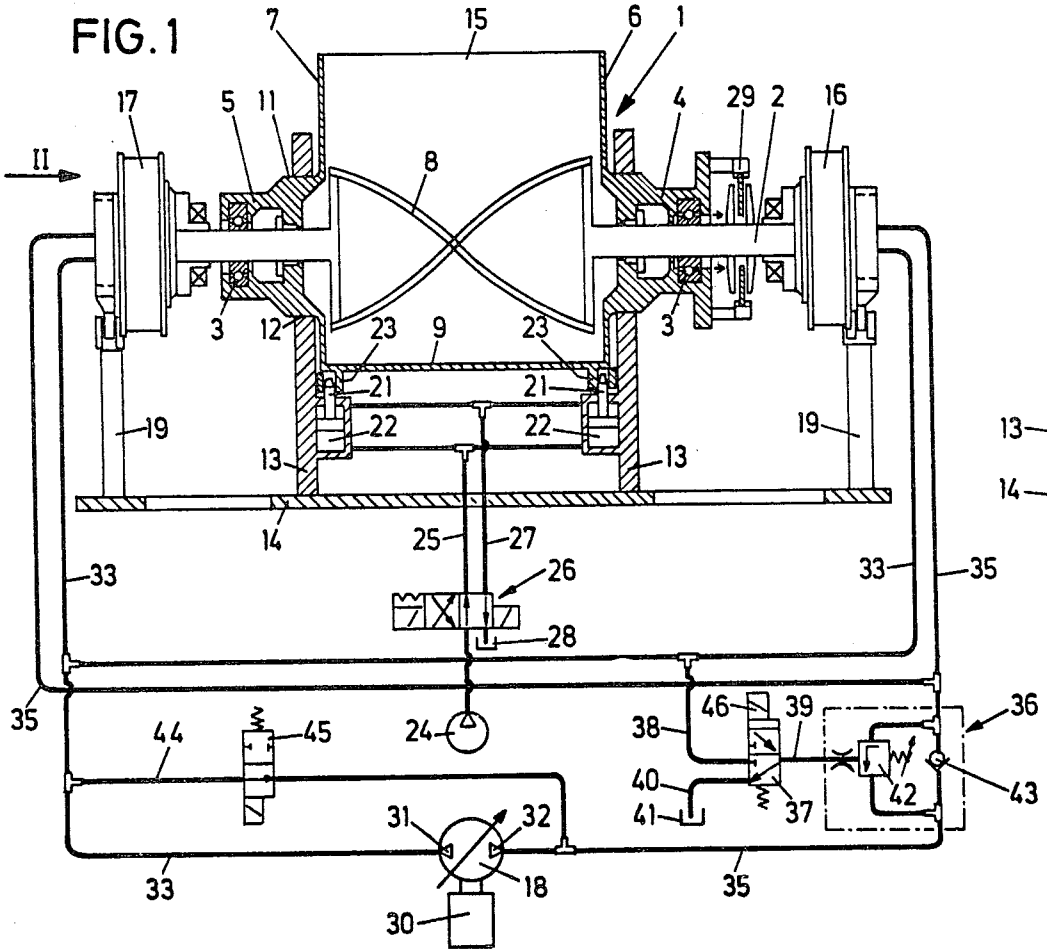
FIG. 1 is a partially broken away, side elevational view of one embodiment of this invention, the hydraulic supply being shown in the form of a hydraulic circuit diagram.

As shown in FIG. 1, the mixer, which is a batchwise, i.e. discontinuously operable kneader mixer, has a mixing trough 1, in which a mixing shaft 2 is rotatably mounted by means of bearings 3, which are in turn arranged in bearing boxes 4, 5 positioned on the end walls 6, 7 of the mixing trough 1. In conventional manner, the mixing shaft 2 carries mixing and kneading blades 8 which form an envelope that is approximately cylindrical. Mixing and kneading blades 8 are disposed so that there is a limited clearance with respect to the inner wall 9 of the mixing trough 1.

Figure 2:
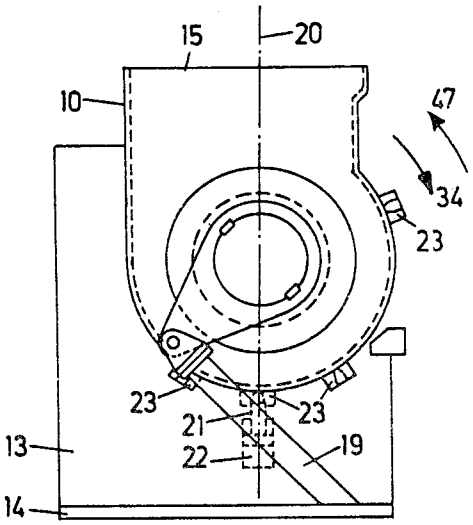
FIG. 2 is an elevational view of the embodiment of FIG. 1, in the direction of the arrow II.

As best shown in FIG. 2, the inner wall 9 of the mixing trough 1 is cylindrically constructed over a circumferential angle of more than 180°. In the upward direction it is followed by an approximately parallelepipedic portion 10 of the mixing trough 1, which is not subject to the action of the blades 8. To this extent, the mixer is known and is of a commercially available construction.

On the outer circumference of the bearing boxes 4, 5 there are cylindrical collars 11, which are supported in corresponding bearing openings 12 of support walls 13, which are in turn fixed to a base plate 14. As a result of the rotary mounting in the support walls 13, the mixing trough 1 can be swung out of its normal upright position (as shown in FIG. 2) in which it's feeding and emptying opening 15 lies on top. Two hydraulic motors 16, 17 are fixed to the two outer free ends of the mixing shaft 2. Motors 16, 17 are supplied with hydraulic fluid by a hydraulic pump 18 to drive shaft 2 and, consequently, mixing blades 8. The hydraulic motors 16, 17 do not have their own foundations but are mounted on the mixing shaft 2. They are supported in torque-resistant manner by a torque support 19 that is connected, on the one hand, to the base plate 14 and, on the other hand, to the motor 16 or 17.

The mixing trough 1 can be indexed in several different pivoting positions, i.e. out of its normal upright position in which its vertical central plane 20 is swung out of its vertical normal position. In order to fix the mixing trough in the various different pivoted positions, indexing bolts 21 are fitted to the support walls 13. Cylinders 22 hydraulically or pneumatically operate indexing bolts 21. Bolt receptacles 23 fixedly disposed on the outer circumference of the mixing trough 1 are associated with the indexing bolts 21. Only four such bolt receptacles pump 24 are shown in FIG. 2.

To supply the cylinders 22 with pressure, a pump 24 is provided which is connected to cylinders 22 by pressure line 25. Pressure line 25 is connected to a 4/2-way solenoid valve 26. In the inoperative position of the solenoid valve 26, as shown in FIG. 1, the cylinders 22 are supplied with pressure via pressure line 25 so that the bolts 21 extend into receptacle 23. In this manner, the mixing trough 1 is firmly locked in its set position. the upper working chambers of the cylinders 22 are connected to a storage tank or reservoir 28 for the pressure medium via a return line 27, which is also guided by the solenoid valve 26. Exciting the solenoid valve 26 causes the pressure to be supplied in the opposite direction to the cylinders 22 via pressure line 25 and return line 27, which are connected in cross-like manner. Thus, the indexing bolts 21 are withdrawn from the bolt receptacles 23 to enable the mixing trough 1 to pivot.

The solenoid valve 26 has a self-holding construction, i.e. there is no pressure relief of the cylinders 22 if there is a power failure stopping the operation of the pump 24. In that case, the bolts 21 would remain in the locked position in the receptacles 23. Such solenoid valves 26 are commercially available.

Between the hydraulic motor 16 and the adjacent bearing box 4 on the mixing shaft 2 is fitted a driving clutch 29 by means of which the shaft 2 can be coupled in non-rotary manner to the adjacent bearing box 4 of the mixing trough 1. In the normal position shown in FIG. 1, the clutch is open, so that the mixing shaft 2 can be freely rotated with respect to the bearing box 4 and consequently the mixing trough 1. Coupling only takes place when the clutch is closed.

The pump 18 is constructed as a reversible displacement-controllable pump, i.e. after corresponding reversal it can deliver pressure in one direction 31 or the opposite direction 32 by means of an associated adjusting device 30. The pump delivery flow per time unit is adjusted by means of the adjusting device 30. Pumps 18 are of a commercially avaiable type. If the pump 18 delivers in the direction 31, it supplies the pressure medium by means of a branching forward flow line 33 to the hydraulic motors 16, 17 which then drive the mixing shaft 2 and blades 8 in a forwardly rotational direction as indicated by the arrow 34 in FIG. 2. By means of the joining pressure lines 35, the pressure medium flows back to the pump 18 through a back-pressure valve 36, which is opened for this purpose. All the valves are shown in the inoperative position in FIGS. 1 and 3.

To hydraulicly control the back-pressure valve 36 an electromagnetically operable pilot valve 37 is provided, whose intake is connected to the forward flow line 33 by means of a supply line 38. An outlet of the pilot valve 37 is connected via a control line 39 to a control inlet of the back-pressure valve 36. In the de-energized state of the pilot valve 37, the control line 39 is connected to hydraulic tank 41 via a discharge line 40.

The back-pressure valve 36 is, for example, a single-acting back pressure valve of type 25625 of the Racine Company. In addition to a passage 42 opened by means of control pressure on the control line 39 and closed in the case of a relief action on the control line 39, it has a parallel non-return valve 43, which prevents a return flow of the pressure medium through the return line to the pump when the passage 42 is closed. Thus, the passage 42 is closed when the control line 39 is relieved.

Between the forward flow line 33 and the return line 35 there is a short-circuit line 44 bridging the pump 18 and which contains a solenoid valve 45 enabling the opening or closing of said line 44. When the hydraulic motors 16, 17 are not driven, the solenoid valve 45 is opened in the short-circuit line 44, because the pump 18 always delivers at least a small amount of pressure. The solenoid valve 45 is closed when the hydraulic motors 16 and 17 are to be driven.

To drive the mixing shaft and blades 8 in a forwardly rotational direction as indicated by arrow 34 in FIG. 2, the passage 42 must be opened. In this case, the pilot valve 37 must be energized by means of its operating mechanism 46, so that control pressure reaches the back-pressure valve 36 from the forward flow line 33 and via the supply line 38 and control line 39. The return from the hydraulic motors 16, 17 can take place via the return line 35.

If the mixing trough 1 is pivoted in the forwardly rotational direction of arrow 34 in the case of a non-drive mixing shaft 2, the driving clutch 29 is closed. By operating cylinders 22 in the aforementioned manner the indexing bolts 21 are removed from the bolt receptacles 23. The pilot valve 37 is energized, so that the passage 42 is opened. The adjusting mechanism 30 is set so creep liquid flows to displacement-controllable radial or axial piston pumps to drive the hydraulic motors 16, 17 at a speed of less than 1 r.p.m. On reaching the desired pivoted position, the pilot valve 37 is de-energized via the actuating mechanism 36, so that the control line 39 is short-circuited via the discharge line 40 to the tank 41. The passage 42 is closed. As a result, the return of the hydraulic fluid is blocked, so that the mixing trough 1 is secured against further pivoting from the desired pivoted position.

If the mixing trough 1 is to be kept in a pivoted position for a long time, it is necessary to lock it with the indexing means. This is done subjecting the cylinders 22 to pressure action via the pressure line 25, so that the indexing bolts 21 engage in the corresponding receptacles 23. The driving clutch 29 is also then opened. In this inclined position of the mixing trough, the mixing shaft can also be driven in the aforementioned manner for mixing operation.

To drive the hydraulic motors 16, 17 and, consequently, also the mixing shaft 2 and the blades 8 in the rearwardly rotational direction as indicated by the arrow 47 in FIG. 2, initially the adjusting mechanism 30 of the pump 18 is operated in such a way that it pumps the hydraulic fluid in direction 32. In this case the functions of the forward flow line 33 and the return line 35 are reversed. However, to facilitate understanding, the terminology has not been changed. Thus, the solenoid valve 45 and consequently the short-circuit 44 are closed. The hydraulic fluid then flows through the line 35, through the non-return valve 43 in the back-pressure valve 36 and then via the branching lines 35 to the hydraulic motors 16, 17. It flows via line 33 back to the pump 18.

However, in the construction as shown in FIG. 1, it is not possible to pivot the mixing trough 1 in the direction 47. For this purpose, and in the manner shown in FIG. 3, an identically constructed back-pressure valve 36′ is provided in the forward flow line 33. All the corresponding parts are provided with the same reference numerals, to which is added an apostrophe, so that there is no need for a further detailed explanation. The two pilot valves are replaced by a single 4/3-way valve constituting a pilot valve 37′ in place of the 3/2-way valve 37. The two supply lines 38, 38′ are led jointly to the pilot valve 37′, a changeover valve 48 being provided at the junction. As a result of the valve 48, when pressure is exerted on the supply line 38, a pressure drop via the supply line 38′ is prevented and vice versa.

The operation is identical to that described hereinbefore when driving the mixing shaft 2 in the forwardly rotational direction of arrow 34 or on pivoting the mixing trough 1 in the direction of arrow 34.

Figure 3:
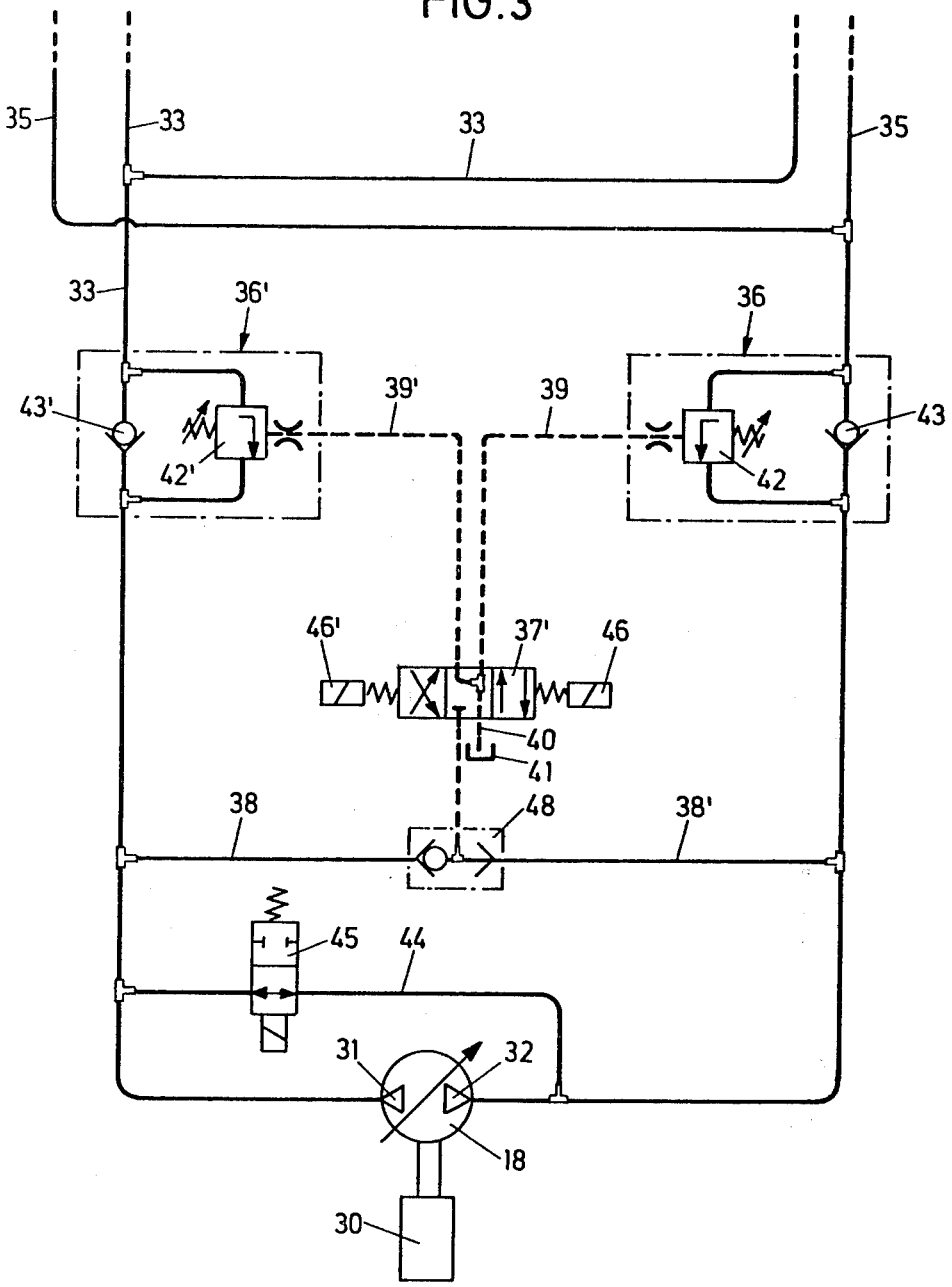
FIG. 3 is a schematic diagram of the hydraulic circuit forming a part of the embodiment of FIG. 1.

In the construction shown in FIG. 3, driving the shaft 2 and the mixing blades in the rearwardly rotational direction of arrow 47 or pivoting the mixing trough 1 in the direction of arrow 47 is the same as the operation for forward drive. For rearward drive or rearward pivoting by means of the actuating mechanism 46′, control pressure is supplied from the line 35 via the supply line 38′ to the control line 39 on the back-pressure valve 36′, so that the passage 32′ is opened. On de-energizing the pilot valve 37′, the control line 39′ is relieved again via the discharge line 40 to the tank 41, so that the passage 42′ is closed. The mixing trough 1 is hydraulically fixed in this position. The mixing trough can optionally be locked in this position, so that mixing shaft 2 can be normally driven in one of the two rotational directions of arrow 34 or arrow 47.

Figure 4:
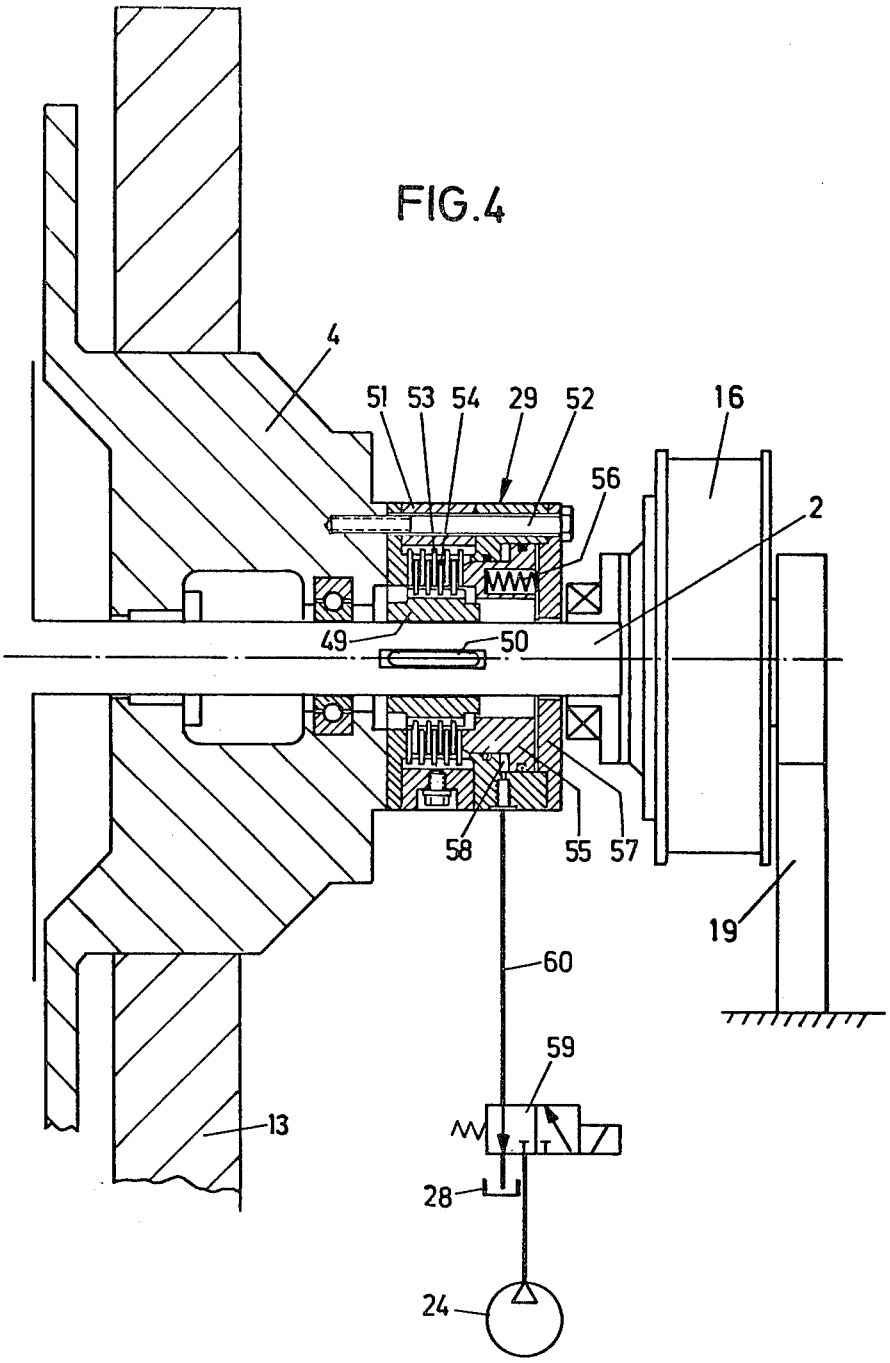
FIG. 4 is a cross-sectional view of a driving clutch forming part of the embodiment of FIG. 1.

As shown in FIG. 4, the driving clutch 29 is a hydraulically lifted spring pressure disc clutch, whose inner ring 49 is connected in non-rotary manner with the mixing shaft 2 by means of an adjusting spring 50. Its outer ring 51 is fixed by means of tightening screws 52 to the bearing box 4. In conventional manner, discs 53, 54 are arranged in alternating manner on the inner ring 49 and outer ring 51 respectively. The discs 53, 54 are axially subject to the action of a lifting cylinder piston 55 which, by means of biased compression springs 56 supported against a cover 57, is pressed against the alternately arranged discs. A non-positive connection is thus produced betwen the inner ring 49 and outer ring 51 and consequently between the mixing shaft 2 and bearing box 4. For lifting the cylindrical piston 55, i.e. for opening the driving clutch 29, a pressure medium is passed into a pressure chamber 58 in which the cylindrical piston 55 is displaceably arranged. The piston 55 is thus raised from the discs 53, 54 counter to the action of the compression springs 56. Pressure is supplied by the pump 24 via a control valve 59 and a corresponding control line 60.

I claim:

1. A mixer having a mixing trough; rotatable mixing and kneading blades within the mixing trough; a charging and discharging opening in said mixing trough; a rotable mixing shaft connected to said blades, said trough being pivotable about the shaft; at least one motor connected to said shaft to rotate said shaft, the mixing trough being pivotable by means of the motor; and means for indexing the mixing trough in at least one pivoted position, wherein the indexing means comprises a clutch means connected to said shaft and trough to permit rotation of the trough with the shaft, and wherein the motor comprises at least one hydraulic motor directly coupled to the mixing shaft and reversibly drivable by means of a displacement-controllable pressure pump, said clutch being connected between the mixing shaft and the mixing trough and an indexing fixing device connected to the mixing trough to fix said trough in different pivoted positions.

2. A mixer according to claim 1 wherein said hydraulic motor and the pressure pump are interconnected by means of fluid lines and a back-pressure valve controllable by a pilot valve is provided in at least one fluid line.

3. A mixer according to claim 1, wherein said hydraulic motor is carried by the mixing shaft and is supported in a torque-resistant manner.

4. A mixer according to claim 1, 2, or 3 comprising an indexing fixing device formed by at least one displaceable indexing bolt and a plurality of bolt receptacles connected to the mixing trough to lock said trough in at least one pivotal position.

5. A mixer according to claim 4 wherein each indexing bolt is adjustable by means of a pressure-operable cylinder.

6. A mixer according to claims 1 or 2 wherein the pressure pump is provided with an adjusting mechanism for regulating the delivery direction and displacement.

* * * * *

UNITED STATES PATENT AND TRADEMARK OFFICE

CERTIFICATE OF CORRECTION

PATENT NO. : 4,416,545

DATED : November 22, 1983

INVENTOR(S) : Heinz Krimmel

It is certified that error appears in the above—identified patent and that said Letters Patent is hereby corrected as shown below:

Col. 1, Line 6, "though" should be --trough--.

Col. 3, Line 30, delete "pump"; change "24" to --23--.
On the title page add: -- /73/ Assignee: Werner & Pfleiderer, Stuttgart, Germany--.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*